United States Patent [19]

Zimmer

[11] Patent Number: 4,554,868

[45] Date of Patent: Nov. 26, 1985

[54] APPARATUS FOR COMPACTING REFUSE WITH STABILIZERS

[76] Inventor: John C. Zimmer, 502 Estate Dr., New Iberia, La. 70560

[21] Appl. No.: 457,429

[22] Filed: Jan. 12, 1983

[51] Int. Cl.[4] ..... B30B 15/06

[52] U.S. Cl. ..... 100/229 R; 100/255; 100/295; 100/902; 141/73; 141/390

[58] Field of Search ..... 100/229 R, 229 A, 255, 100/49, 53, 295, 221, 224, 100, 902; 141/71, 73, 80, 316, 390

[56] References Cited

U.S. PATENT DOCUMENTS

| | | | |
|---|---|---|---|
| 56,456 | 7/1866 | Levy et al. | 100/229 R |
| 312,968 | 2/1885 | Carey | 100/295 |
| 2,224,908 | 12/1940 | Griffith | 141/390 |
| 2,641,122 | 6/1953 | Cavagnaro et al. | 100/229 R |
| 2,782,710 | 2/1957 | Fishburne | 100/100 |
| 2,798,348 | 7/1957 | Weber et al. | 100/221 |
| 2,970,533 | 2/1961 | Allen | 100/229 A |
| 3,353,478 | 11/1967 | Hopkins | 100/229 R |
| 3,602,136 | 8/1971 | Ligh | 100/229 R |
| 3,754,503 | 8/1973 | Hennells | 100/229 A |
| 3,851,577 | 12/1974 | Newcom et al. | 100/255 |
| 3,862,595 | 1/1975 | Longo | 100/229 A |
| 3,868,903 | 3/1975 | Montalbano | 100/255 |
| 4,008,658 | 2/1977 | Stock | 100/229 R |
| 4,022,123 | 5/1977 | Bachmann | 100/229 R |
| 4,212,240 | 7/1980 | Lee et al. | 100/229 A |

FOREIGN PATENT DOCUMENTS

| | | | |
|---|---|---|---|
| 421060 | 8/1946 | Italy | 100/255 |
| 567586 | 10/1957 | Italy | 100/229 R |

*Primary Examiner*—Billy J. Wilhite
*Attorney, Agent, or Firm*—Keaty & Keaty

[57] ABSTRACT

An apparatus for compacting refuse providing an ability to compact refuse in a drum or in a bag or providing for the compaction of drums themselves which are unwanted. The apparatus provides a supportive frame having a platform on the frame upon which a drum or bag can be supported at its bottom. A provided jacket assembly can be opened for placement about the drum or bag, the jacket after closure supporting the drum or bag about its sides during compaction. A hydraulic ram having an attached compacting disk is supported vertically above the support platform and during operation compacts refuse within the jacket and in the drum or bag as desired maximizing the quantity of trash contained within a particular drum or bag for later disposal. During the compacting operation, a drum or bag is supported on its bottom by the platform on its side by the jacket and the trash is compacted from above by the compaction disk. When a bag is used, the jacket assembly supports compaction. By leaving the lid on a drum (as e.g. a 55 gallon oil drum) the drum itself can be crushed for disposal as scrap. An enlarged compacting disk or an enlarged adapter for the stock compacting disk could alternatively be provided if drums are to be crushed, the crushing of drums being of particular utility on oil and gas drilling platforms where drums are plentiful and space is at a premium.

6 Claims, 24 Drawing Figures

APPARATUS FOR COMPACTING REFUSE WITH STABILIZERS

BACKGROUND OF THE INVENTION

1. Field of the Invention

The present invention relates to an improved refuse compactor and more particularly relates to a compactor apparatus capable of compacting refuse in drums or in bags wherein the compaction is supported at its sides by stabilizers mounted to the jacket of the compactor.

2. General Background

In the offshore oil industry, drilling platforms are provided for the drilling of oil and gas which are very expensive structures that require space to be minimized in order to save construction costs. The operating cost for drilling platforms is quite high and space is at a premium. One of the significant problems in the offshore oil industry is the removal of refuse generaterd from the rig which can be in the form of trash, garbage, paper products, scrap metal, containers and the like. Oil and gas well drilling necessarily generates a large number of empty drums which are brought on to the rig for a variety of purposes such as the containment of fuel, oil for lubrication, grease, cleaning products, miscellaneous petroleum products, and the like. Thus, during the drilling process a large number of empty drums can be quickly generated which create a storage problem for the drilling platform which is in need of space at all times. A solution to this problem would be to dispose of the drums in a simple and economical fashion.

It would be of great utility to provide a single apparatus for compaction of refuse in bags or in drums (as 55 gallon oil drums, e.g.) and to further be able to crush the drums themselves without refuse in them.

Compacting devices are known. Several devices have been patented which attempt to solve the problem of compacting trash so as to compact as much garbage or trash as possible within a small containerized space.

It is also known to provide some type of support during certain compaction processes such as baling, for example. The following patents briefly described some of the devices which have been patented that attempt to solve the problem of compacting trash, and/or supporting materials which are being compacted.

Bachmannin U.S. Pat. No. 4,022,123 discloses a garbage compactor comprising lower base and upper top horizontal plates connected by rigid bars, upon which an container for the storage of garbage is pivotly fixed and slidable, so that it may be swung around the bar and displaced along the bar. The top plate is a carrier for an hydraulic press assembly. A hinged wall of the octagonal container can be operated to provide for removal of a bag inserted after it has been filled with compacted garbage.

Stock in U.S. Pat. No. 4,008,658 teaches the use of a trash compactor comprising a cylindrical waste receptacle and a loading chamber above the receptacle. The doors are operatively connected to the receptacle, which includes a power ram for compressing waste material. The device also comprises filters for removing particles contained in the atmosphere is a result of the compacting operation.

J. Longo in U.S. Pat. No. 3,862,595 discloses a movable vertical trash compactor comprising a base on which a refuse receptacle is located and which has a vertical column extending adjacent thereto. A ram mounted on the column is moved up and down into the container thus compacting the waste material in the container or receptacle.

W. Newcom, et al in U.S. Pat. No. 3,851,577 describe a vertical baler for baling paper scraps which is characterized by a hydraulic system being a structural integral part of the roof of the baler. The apparatus comprises a pair of pivotally mounted doors and compacting cylinder which is periodically caused to descend and compress the waste material which is then baled and ejected in a conventional manner.

D. Ligh in U.S. Pat. No. 3,602,136 discloses a refuse compactor comprising a cylindrical housing with an internal chamber, and a compacting head arranged therein for guided axial sliding in the chamber. Refuse is introduced in the chamber through a door in a side wall of the chamber and then it is compressed by a hydraulic piston or a mechanical screw.

Hopkins in U.S. Pat. No. 3,353,478 discloses a waste collecting and compacting unit of a cabinet structure comprising an expendable receptacle with an open top, and electrically operated compression means for compressing the waste material which is then removed from the receptacle. The compacting member has a lead end irregular compressing surface to provide for the application of various pressure movements on irregular surfaces.

The waste container disclosed in U.S. Pat. No. 2,970,533 comprises a rigid container with an open top, the container including two sections, a first fixed and a second hinged, which is pivotally connected to a base of the container. The shape of the ram head is conincident wth that of a disposable bag placed in the container. A foot treadle pivotally higed to the base is connected to an arm extending perpendicularly from the ram head by means of which the foot treadle is depressed to place the ram head within the bag and compress the waste material.

U.S. Pat. No. 2,641,122 describes a hydraulic expresser for expelling liquid from wet material by squeezing it by an electrically operated hyraulic press. A movable bottom member of the container is adapted to carry out the material subject to compression between the head member and the reciprocal ram.

U.S. Pat. No. 56,456 describes a baling press for cotton and the like, which is manually operated and comprises a set of baling trunks mounted on wheels, which run on a suitable railway. The device also comprises a frame, a hand wheel with a crank and spokes, while the motion is transferred through a number of spur-wheels and pinions from a hand-wheel to a rack which descends and presses the cotton in a trunk.

The present invention solves the prior art problems and shortcomings in a simple and straightforward manner by providing an apparatus which allows trash as accumulated on an offshore oil or gas platform or other such commercial installation to be compacted in readily available flexible bags or in disposable drums such as, for example, standard commercially available 55 gallon drums.

The present invention provides an apparatus which allows refuse to be compacted within a drum with the apparatus being provided with stabilizing members for efficient compaction.

The present invention further provides an apparatus also being capable of compacting trash within a bag and further being capable of crushing 55 gallon or like disposable drums by means of an adjustable compaction disk.

GENERAL DISCUSSION OF THE PRESENT INVENTION

The present invention provides an improved compactor apparatus for use with disposable drums and flexible bags which provides a supportive frame having a runway supporting a movable compaction platform. A cylindrical jacket assembly with removable stabilizers is removably positioned during operation on the platform and about a drum or a bag to provide support against lateral deformation of said drum during compaction and to support and contain refuse being compacted as when a bag is used. A hydraulic ram having an adjustable compaction disk attached to it is positioned vertically above the platform and disposable drum or bag. The ram compacts trash within the jactket assembly during extension of the cylinder. During such compaction, the drum or bag is supported against lateral deformation by the jacket adapted with stabilizers and against vertical deformation by the platform. The jacket assembly comprises, in the preferred embodiment, a cylindrical jacket which is split into three cylindrical portions of substantially equal size which are, for example, hingedly connected at one edge portion with latches being provided opposite the hinge to secure the cylindrical jacket assembly in a closed position during compaction. The platform is movably mounted on the runway being provided with grooved casters, the grooves of the casters resting on rails provided on the runway and allowing the platform to be rolled between compacting (under the ram) and unloading (removed laterally away from the ram) positions. A safety feature to insure centering of the jacket under the ram provides a microswitch and an adjustable stop behind the runway which stops rearward travel of the platform and indexes the platform and jacket under the ram, with proper indexing tripping the microswitch to energize an operating circuit.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
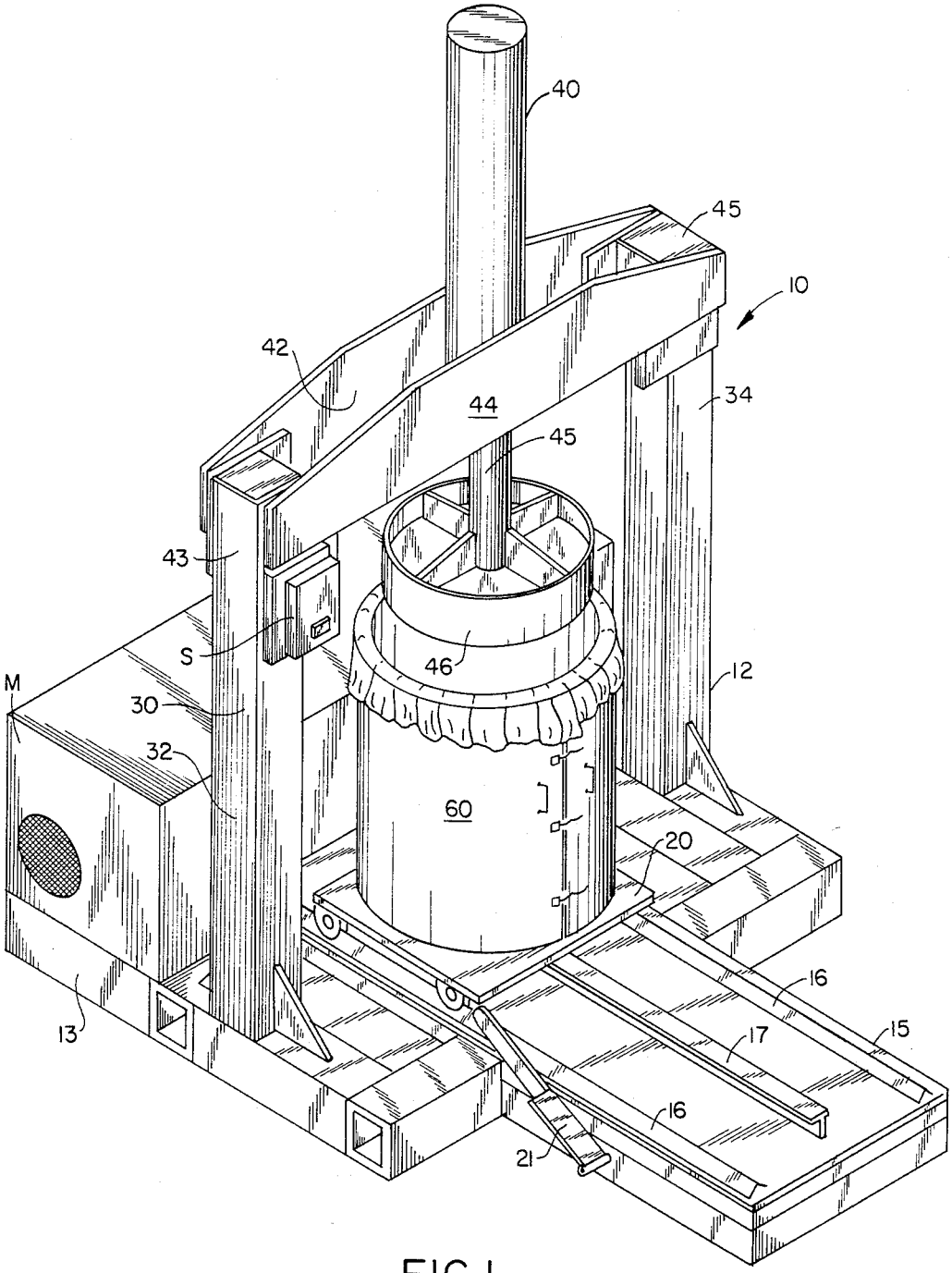
FIG. 1 is a perspective view of the preferred embodiment of the apparatus of the present invention.
Figure 18:
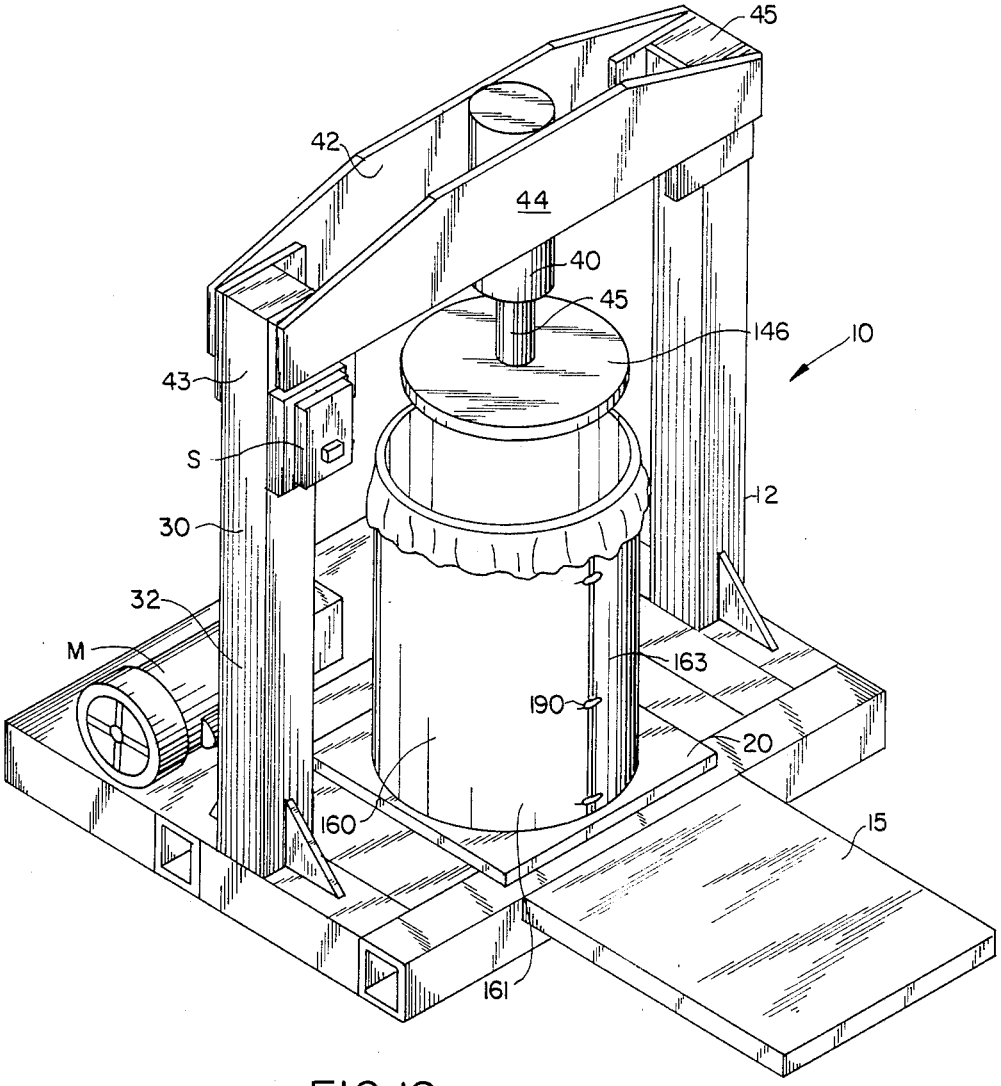
FIG. 18 is a partial perspective view of the alternate embodiment of the apparatus of the present invention with rails, casters, and lever removed for clarity.
Figure 20:
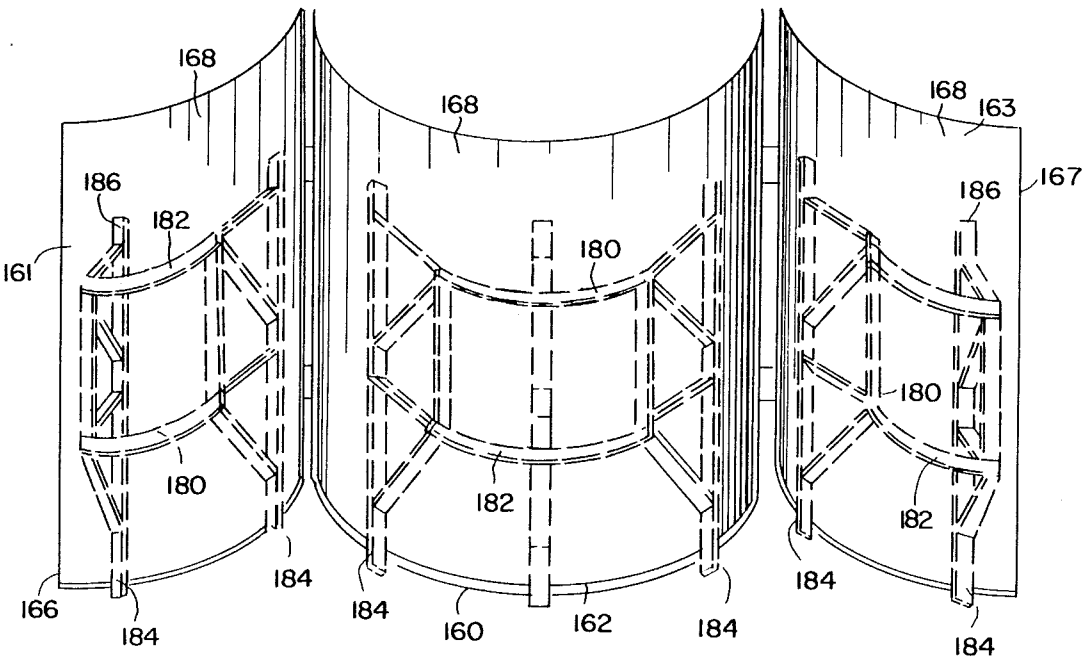
FIG. 20 is a partial perspective view of the alternate embodiment of the present invention illustrating the stabilizers mounted onto the jacket portion.

FIG. 1 shows an overall view of the preferred embodiment of the apparatus of the present invention, and designated generally by the numeral 10. Compacting apparatus 10 comprises generally a supportive frame 12 having a lower horizontal base 13 providing runway 15 which supports movable platform 20. Attached to base 13 is upper superstructure 30 supporting cylinder 40 vertically above platform 20, which can be an hydraulically operated cylinder. Also provided, as shown in FIG. 1, is cylindrical jacket assembly 60 which during operation rests upon platform 20. In the alternate embodiment cylindrical jacket assembly 160 is illustrated in FIG. 18.

Cylinder 40 is provided with an extendable ram 45 portion which has attached to its lower end portion thereof a circular compaction disk 46. Disk 46 would preferably be of an external diameter (OD) substantially identical to or smaller than the inner diameter (ID) of a provided disposable drum 70 which would be placed during the compacting operation within jacket 60.

Figure 11:
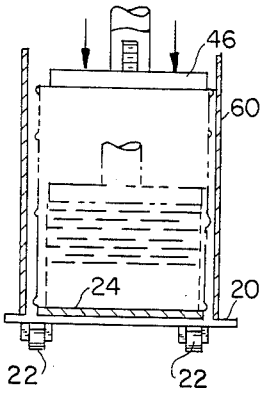
FIG. 11 is a partial schematic sectional view of the preferred embodiment of the apparatus of the present invention illustrating compaction of refuse inside a drum.
Figure 9:
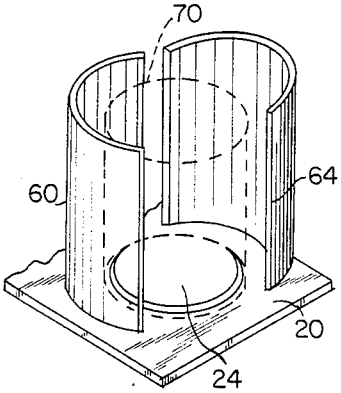
FIG. 9 is a partial perspective view of the preferred embodiment of the apparatus of the present invention illustrating the jacket portion thereof in an open position.
Figure 10:
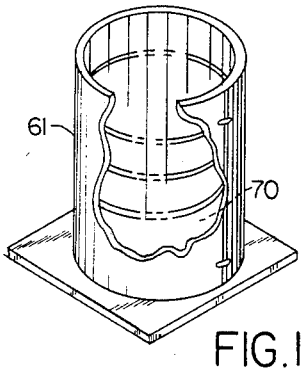
FIG. 10 is a prespective view of the preferred embodiment of the apparatus of the present invention illustrating the jacket portion thereof as assembled about a drum.

Drum 70 and its position within jacket 60 is best seen in FIG. 9–11.

Figure 2:
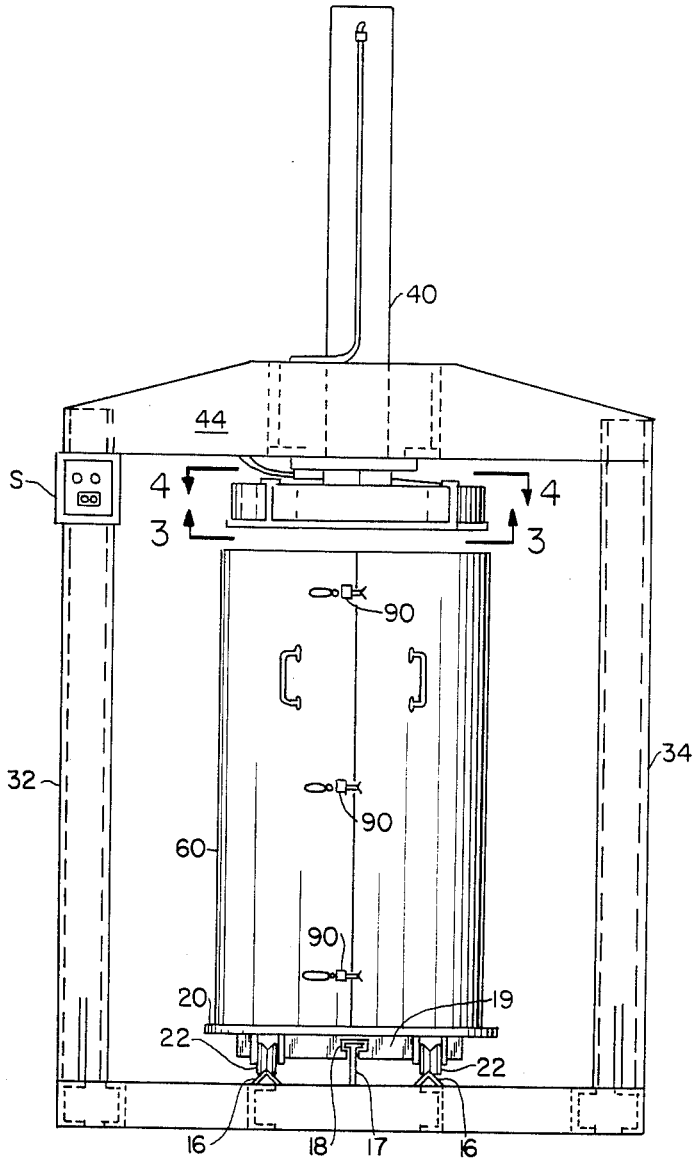
FIG. 2 is a front elevational view of the preferred embodiment of the apparatus of the present invention.
Figure 21:
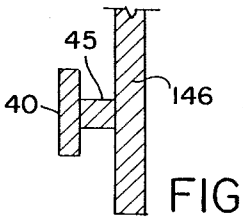
FIG. 21 is a side view of the compaction disk of the alternate embodiment of the apparatus of the present invention.
Figure 22:
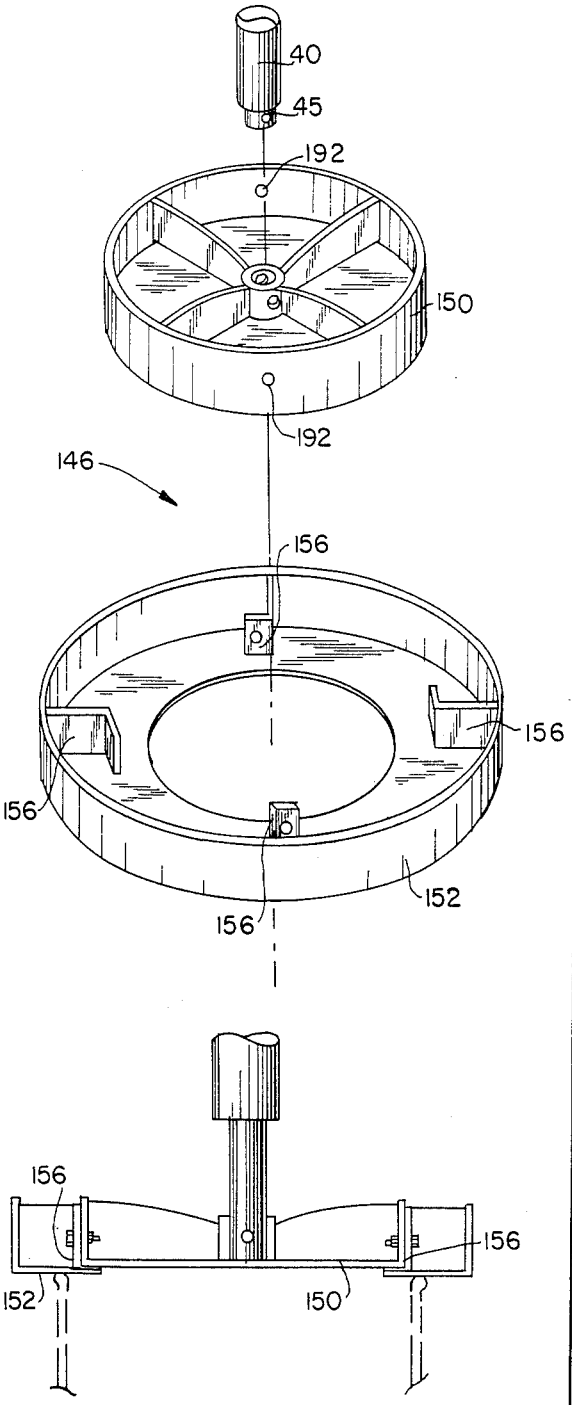
FIG. 22 is an exploded view of the compaction disk of the alternate embodiment of the apparatus of the present invention.

In the alternate embodiment circular compaction disk 146, as seen in FIGS. 21 and 22, is comprised of an inner disk portion 150 and removable outer disk portion 152 which have a central bore of a diameter slightly less than the diameter of inner disk 150. Inner disk 150 and outer disk 152 are connected by a plurality of L-shaped ribs 156 welded to outer disk 152 and attached by bolting to inner disk 150 at holes 192 in inner disk 152. Platform 20 would normally be movably mounted upon runway 15 of frame 12 by supplying platform 20, for example, with grooved casters 22 as best seen in FIG. 2. Runway 15 can have spaced rails 16 which engage grooved casters 22 to discourage lateral movement of platform 20 with respect to runway 15 yet allow fore-aft movement. An anchor 17 such as a tee-beam welded to runway 15 and parallel to rails 16 would retain platform 20 on runway 15, discouraging its removal by tipping, for example. A tee-shaped recess 18 in platform 20 which could be in cross beam 19 of platform 20 would cooperate with the anchor tee-beam 17 to provide the desired anchor assembly. A stop pedal 21 could be hingedly affixed to runway 15, and be normally biased upwardly by means of a spring or the like. Foot pressure on pedal 21 would disengage it, allowing platform 20 to roll outwardly from its operative position under cylinder 40.

Figure 7:
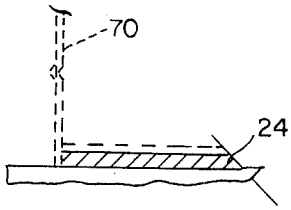
FIG. 7 is a fragmentary detail view of the preferred embodiment of the apparatus of the present invention illustrating the compaction platform and indexing disk portions thereof.

Lower indexing disk 24 would be attached by welding, for example, to platform 20 at its center and would provide extra thickness to platform 20 at the compacting area to prevent rupture of a drum at its bottom and would further provide a means for properly indexing jacket 60 (or jacket 160 in the alternate embodiment) or drum 70 to platform 20 (see FIG. 7). Indexing disk 24 would be, for example, of an external diameter (OD) substantially equal to the internal diameter (ID) of a drum 70 placed thereover.

Figure 6:
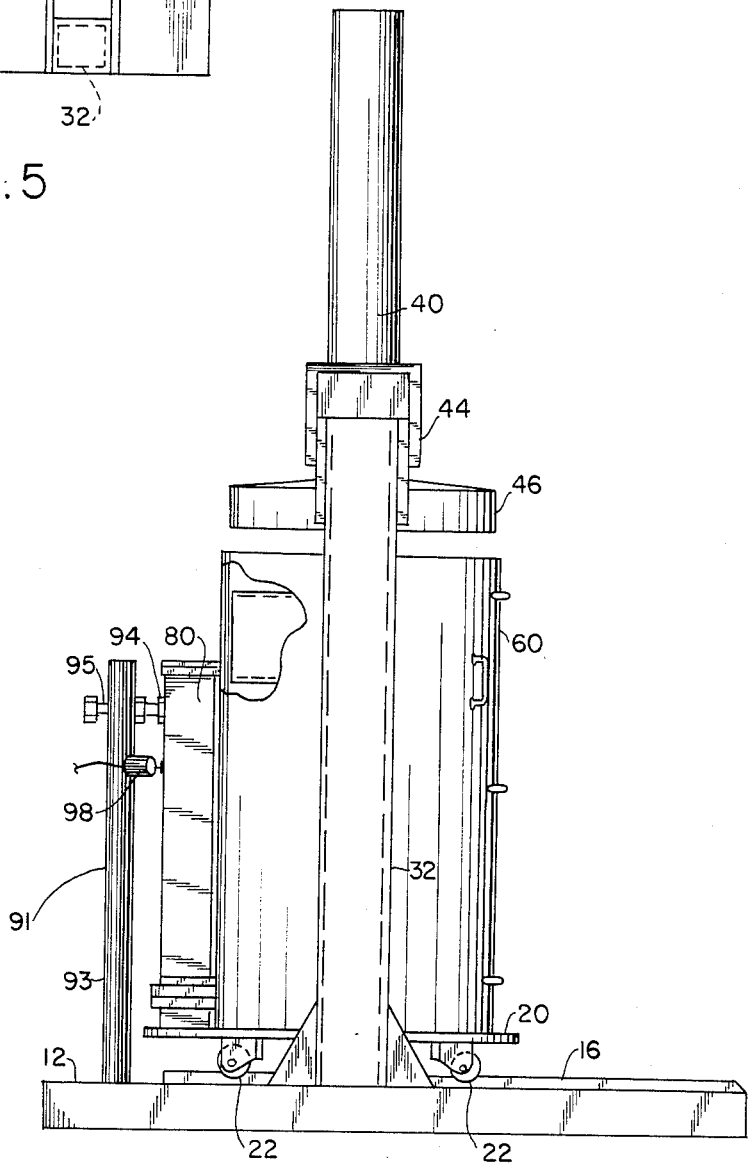
FIG. 6 is a side view of the preferred embodiment of the apparatus of the present invention.
Figure 8:
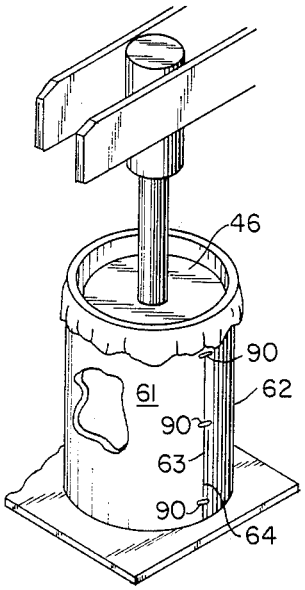
FIG. 8 is a partial perspective view of the preferred embodiment of the apparatus of the present invention schematically illustrating compaction of refuse in a bag.

Frame 12 would comprise a supportive base 13 which could be, for example, rectangular, being manufactured of steel construction or the like with a superstructure 30 having a pair of vertical columns 32, 34 which are attached at their bottom to base 13 with reinforcement by gusseting as shown in FIGS. 1–2 and 6, with columns 32, 34 supporting horizontal support beams 42, 44 which are attached at their end portions at 41, 43 to columns 32, 34 by welding, for example. At the central portion of beams 42, 44 cylinder 40 is attached being vertically oriented to operate in a substantially vertically direction above jacket 60 (or jacket 160 in the alternate embodiment). Cylinder 40 would be aligned so that it rams portion 45 when extended would move compaction disk 46 (or disk 146 in the alternate embodiment) in a vertical direction downwardly into the inner portion of jacket 60 (or jacket 160 in the alternate embodiment) and a provided bag or disposable drum 70 as desired. The connection of cylinder 40 to beams 42, 44 could be, for example, by welding, bolting, or the like. The spacing of beams 42, 44 could be of a distance as shown in FIG. 1 which would allow for the placement of cylinder 40 therebetween with cylinder 40 being attached at opposite sides to beam 42, 44 respectively.

Cylinder 40 could be operated, for example, by an hydraulic motor which is schematically illustrated by the letter M in FIG. 1. Electrical switching could be provided for powering motor M with switching S being schematically shown in FIG. 1 also.

Figure 17:
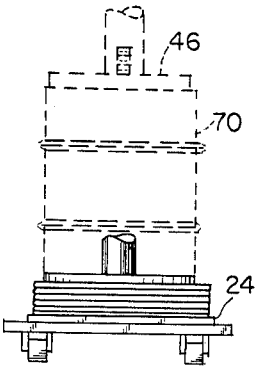
FIG. 17 is a partial elevational view of the preferred embodiment of the apparatus of the present invention schematically illustrating crushing of a drum.

Compaction disk 46 and inner disk portion 150 in the alternate embodiment could be as aforementioned of a diameter equal to or slightly less than the internal diameter of a provided disposable drum 70 which could be, for example, a standard 55 gallon drum. Disk 46 could be removably attached to ram 45 by bolting, threading, or the like so that an enlarged disk could be provided having a diameter greater than the external diameter of drum 70 which would allow compaction of a 55 gallon drum or like disposable drum itself when jacket 60 is removed from its position on platform 20. In the alternate embodiment outer disk portion 152 is removably attached to inner disk portion 150 thereby providing compaction disk 146 with a diameter greater than the external diameter of drum **70*b* which would allow compaction of a 55 gallon drum or like disposable drum when jacket 160 is removed from its position on platform 20. This would allow drums themselves to be compacted for disposal should that be desirable. Drums 70 could be compacted using compaction disk 46 or inner disk 150 in the alternate embodiment if the top of the drum were left on, or if the drum were inverted, with the disk 46 or disk 150 engaging the bottom of the drum 70 during compaction (see FIG. 17**).

Figure 3:
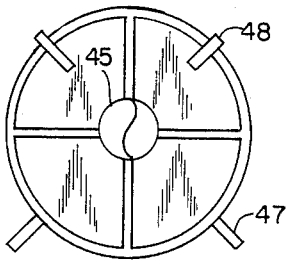
FIG. 3 is a sectional view taken along lines 3—3 of FIG. 2.
Figure 4:
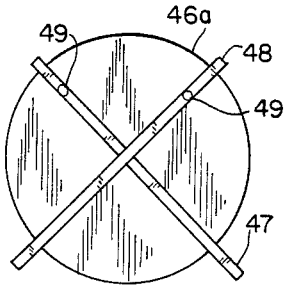
FIG. 4 is a sectional view taken along lines 4—4 of FIG. 2.

FIGS. 3 and 4 show an alternate compaction disk arrangement **46*a* using the disk 46 shown in FIG. 1, but adding a pair of bars 47, 48 which might be attached at their intersection by means of a pinned connection or the like and having a pair of attachments at 49 which might be, for example, bolted connections for bolting the pair of bars 47, 48 to disk 46. Note that an enlarged diameter is thus provided which would allow crushing of a drum 70 even if the top were not available for it. Thus, an enlarged diameter for engaging the top of the drum would be provided by using the cross bar arrangement of FIGS. 3 and 4**.

Jacket 60 comprises generally a pair of jacket halves 61, 62 which are substantially equally sized and are attached along their rear edges together at hinge 80 and at their front edges 63, 64 by means of latches 90.

Jacket 160 comprises generally three jacket portions 161, 162, 163 which are substantially equally sized and are attached along their edges together with hinges in the same manner as jacket halves 61, 62 of jacket 60. Jacket portions 161, 163 are attached along their front edges, 166, 167 by means of a latch (not shown) in the same manner as jacket halves 61, 62 of jacket 60.

Figure 12:
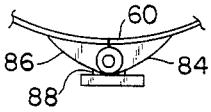
FIG. 12 is a top fragmentary view of the hinged portion of the preferred embodiment of the apparatus of the present invention.
Figure 13:
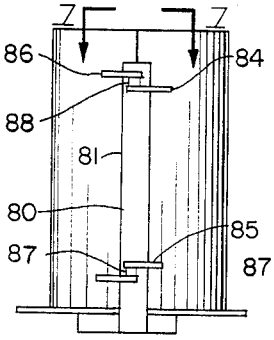
FIG. 13 is a fragmentary rear view of the preferred embodiment of the apparatus of the present invention.
Figure 14:
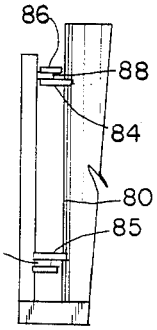
FIG. 14 is a fragmentary side view of the preferred embodiment of the apparatus of the present invention.

The construction and operation of hinge 80 in the preferred embodiment is seen in FIGS. 12–14. Hinge 80 would comprise a vertical hinge plate 81 with connections 82, 88 at which each jacket halve 61, 62 would attach pivotally thereto, allowing the halves 61, 62 to diverge as seen in FIG. 9. Hinge 80 provides a pair of upper hinge elements including upper elements 84, 86 and lower elements 85, 87. Hinge elements 84–85 and 86–87, as above disclosed, and as shown in FIG. 13 would bolt, for example, to horizontal hinge plates 88, 89 which are welded, for example, to vertical plate 81.

Figure 15:
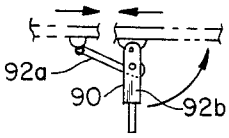
FIGS. 15–16 are partial top views of the preferred embodiment of the apparatus of the present invention illustrating the locking latch portions of the jacket.
Figure 16:
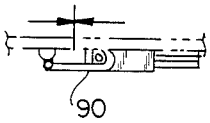

Latch 90 having latch halves **92*a*, 92*b* is seen in FIGS. 15–16. Such latches 90** are commercially available.

Figure 5:
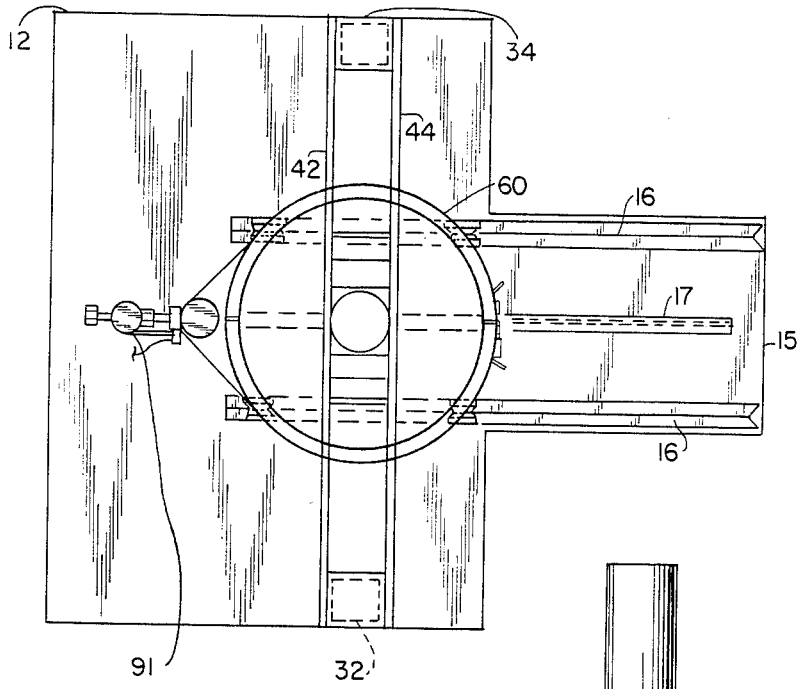
FIG. 5 is a top view of the preferred embodiment of the apparatus of the present invention.

FIGS. 5 and 6 show a safety indexing arrangement designated generally by the numeral 91. An adjustable bolt 95 is attached to, for example, any part of frame 12 which in FIGS. 5 and 6 is provided column 93. It should be understood however, that adjustable bolt 95 could be attached to any portion of frame 12 which would be of suitable structure integrity. Adjustable bolt 95 would be threadably attached, for example, allowing it to move fore and aft with respect to frame 12 and thus change the position of a provided stop 94 at the end portion of bolt 95 adjacent hinge 80. Bolt 95 provides an adjustability as to the rearmost position to which platform 20 will travel when jacket 60 is assembled thereupon. Adjustable bolt 95 could be provided to abut against either hinge 80, jacket 60, or platform 20 as desired. In combination with adjustable stop bolt 95 there is provided a microswitch 98. Microswitch 98 would be switched on to energize the electrical circuit operating motor M and switch box S when the proper indexing position was achived by either runway 20 or jacket 60. Thus, by providing an adjustable stop and a switching arrangement for energizing the circuit when the platform 20 were properly registered vertically under cylinder 40, a safety system is provided which will disallow operation of the device unless the material to be compacted were properly oriented under cylinder 40 and compaction disk 46.

Figure 19:
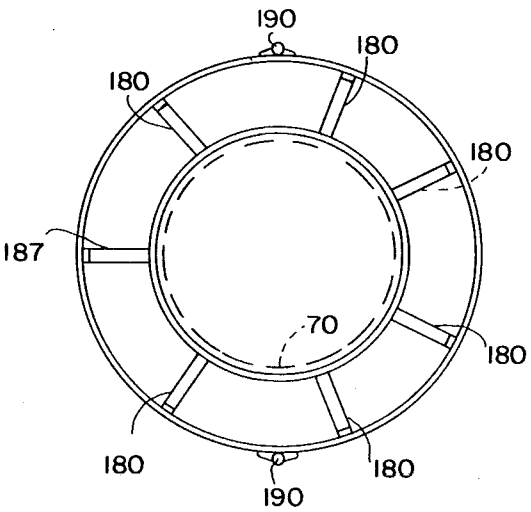
FIG. 19 is a top view of the jacket portion of the alternate embodiment of the apparatus of the present invention with stabilizers mounted therein.
Figure 23:
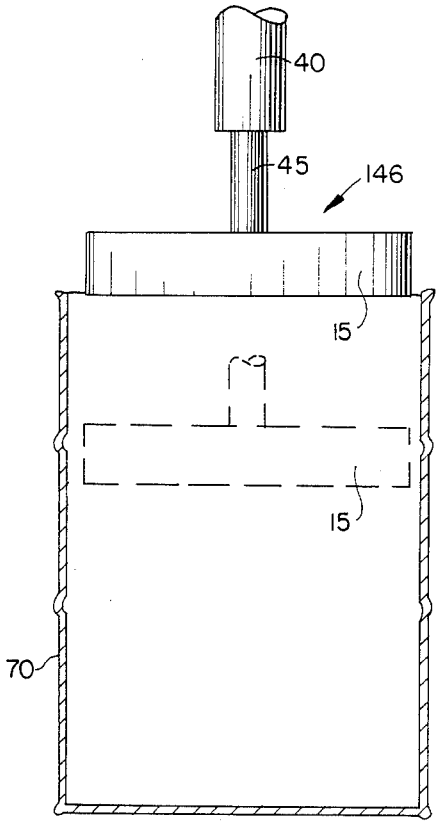
FIG. 23 is a partial schematic view of the alternate embodiment of the apparatus of the present invention illustrating the compaction of refuse inside a drum.
Figure 24:
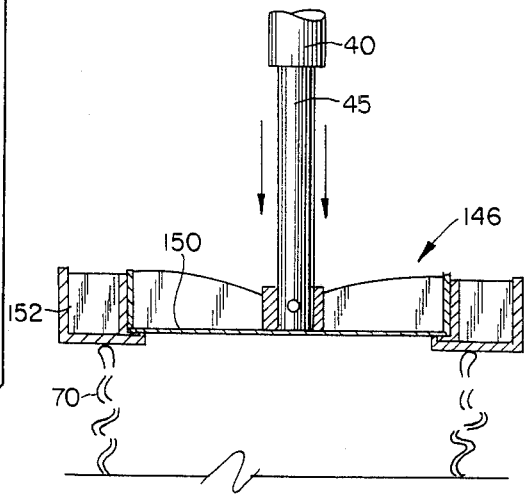
FIG. 24 is a partial elevational view of the alternate embodiment of the apparatus of the present invention schematically illustrating the crushing of a drum.

As seen in FIG. 19, 20 (in phantom lines) jacket 160 in the alternate embodiment is provided with removable stabilizers 180 for use when compacting refuse in drum 70, such as a 55 gallon drum or like. Stabilizers 180 provide a means for centering drum 70 and would only be used when compacting refuse inside drum 70 with disk 150 as seen in FIG. 23 and not when compacting a drum as shown in FIGS. 11 and 24, in that the diameter of disk 146 is only slightly less than the inside diameter of jacket 160 (and jacket 60 in the preferred embodiment) and the stabilizing and centering features are not needed.

Stabilizers 180 are comprised of a pair of curved horizontally positioned straps 182, spaced approximately 2 ft. apart and joined, by welding, to vertical supporting tresses 184 on which are welded on the uppermost portion thereof lips 186 for supporting stabilizers 180 inside jacket 160 and against inner wall surface 168 of jacket 160 against inner wall surface 168 of jacket 160, so that horizontal straps and vertical tresses form an open frame shaped support for drum 70. The curvature of straps 182 are such that when all the stabilizers 180 are mounted in jacket 160 it will snugly support drum 70 at its outer diameter.

Apparatus 10 could be manufactured of, for example structural steel or the like.

The apparatus is operated in the following manner: An operator presses by foot lever 21 allowing platform 20 to slide along the rails forward, clear of the operating zone of compaction disk 46 (or 156 in the alternative embodiment), so that platform 20 is positioned on runway 15. After opening latches 90 (or 190 in an alternative embodiment) the operator opens portions of jacket 60 (or 160 in the alternative embodiment) and loads the trash to be compacted within jacket 60 in a disposable bag or in a drum, or in a compaction container as the case may be. The jacket portions are then brought together and latches 90 closed to assure a structure integrity of cylindrical jacket 60.

By pressing again lever 21, the operator allows platform 20 to slide back to position directly under compaction disk 46 (or 156) with safety indexing means 91 assisting in proper alignment of platform 20 and jacket 60 in relation to a compaction disk.

A motor is then energized and ram portion 45 descends forcing compaction disk 46 (or 156) to compact trash within jacket 60 (or 160).

It should be noted that the operator at no time during operation or non-operation of the press appears under a compaction disk, thereby assuring safety of the apparatus at all times.

An unloading operation is similar to that of the loading proceduring and is repeated starting with pressing of lever 21.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A refuse compacting apparatus, comprising:

a. a frame, said frame providing a horizontal base and an upwardly extending superstructure, rigidly attached to said base;

b. a hydraulic cylinder having a movable driven ram portion and being mounted on said superstructure and being vertically oriented for extending said ram portion of said cylinder in a downward direction;

c. a compaction disk rigidly attached to a lower most end of said ram portion and being movable with said ram portion from an upper idle position to a lower operating position;

d. a movable compaction platform securedly mounted on said base beneath said cylinder during a compaction operation and slidably removable from said base during an unloading operation;

e. an open-ended cylindrical jacket assembly adapted to receive the refuse to be compacted, said jacket assembly being at least in part fixedly attachable to said compaction platform, said jacket having hinges at least on one side of a sidewall and latches on diametrically opposite side of a sidewall for assembling said jacket in the cylindrical operational position and disassembling it in an open-wall position during a non-operation;

f. a compaction container insertable inside said jacket assembly with an external wall of said container at least in part being contacted and supported against lateral movement and deformation by stabilizing means mounted on an interior wall of said jacet assembly;

said stabilizing means comprising a plurality of straps connected together in an open-frame manner and curved to follow cylindrical form of said jacket assembly and said compaction container;

g. a runway portion extending outwardly from said frame to facilitate movement of said compaction platform and said jacket assembly attached thereto between an operating position when said platform is beneath said cylinder and a non-operating position laterally removed from said frame, said runway portion being provided with a pair of parallel spaced-apart rails and an I-beam fixedly attached midway betwen said rails, said platform being provided on its underside with a plurality of castors slidably engaging said rails and a t-shaped groove for slidable engagement with said I-beam of said runway portion, this combination of the rails, the castors, the I-beam and the groove facilitating back and forth movement of said platform along said runway.

2. The apparatus of claim 1, wherein said container is a drum.

3. The apparatus of claim 1, wherein said superstructure comprises a pair of spaced apart support columns, and a beam assembly spanning between the upper portions of said columns with said cylinder being attached during operation to said beam assembly.

4. A compacting apparatus comprising:

a. a frame having a supportive base and a super-structure;

b. an hydraulic cylinder mounted vertically above said base on said superstructure, said cylinder being vertically oriented and being provided with a ram portion which moves between recessed and projected positions along a vertical axis;

c. a jacket assembly mounted on said base and being positionable below said cylinder;

d. a compaction disk attached to a lowermost portion of said ram and being sized to fit within the interior of said jacket assembly; and e. a compaction container insertable during operation inside said jacket with the external wall of said container at least in part being contacted and supported against lateral movement and deformation by stabilizing means mounted within said jacket, said stabilizing means comprising a plurality of straps connected together in an open-frame manner and curved to follow cylindrical form of said jacket assembly and said compaction container.

5. The apparatus of claim 4 further comprising means for moving said jacket assembly between compacting and unloading positions.

6. The apparatus of claim 4 further comprising means for registering said jacket vertically under said hydraulic cylinder.

* * * * *